United States Patent [19]

Baptiste

[11] Patent Number: 4,825,499

[45] Date of Patent: May 2, 1989

[54] SHOWER AND BATH GLOVE

[76] Inventor: Trevor I. Baptiste, 383 Grand Ave., Brooklyn, N.Y. 11238

[21] Appl. No.: 199,462

[22] Filed: May 27, 1988

[51] Int. Cl.[4] ..... A47K 7/02

[52] U.S. Cl. ..... 15/227; 139/396; 2/167

[58] Field of Search ..... 15/222, 227; 2/158, 2/159, 161 R, 164, 167; 139/391, 396; 28/162; 401/6, 7, 8

[56] References Cited

U.S. PATENT DOCUMENTS

| | | | |
|---|---|---|---|
| 1,999,753 | 4/1935 | Diemer | 15/227 |
| 2,012,719 | 8/1935 | Holt | 139/396 |
| 2,363,697 | 11/1944 | Schirmer | 15/227 X |
| 2,431,433 | 11/1947 | Solakian et al. | 15/227 |
| 2,569,067 | 9/1951 | Livshin | 15/227 |
| 3,721,274 | 3/1973 | Sherrill et al. | 139/396 |

FOREIGN PATENT DOCUMENTS

| | | | |
|---|---|---|---|
| 1107345 | 8/1955 | France | 15/227 |

*Primary Examiner*—Peter Feldman

[57] ABSTRACT

A pair of gloves for showering and bathing, wherein each glove of the pair is provided with an inner surface composed of twisted loops pile. The gloves are fabricated from a two sided twisted loops surface terry cloth fabric, so that when formed, a plurality of twisted loops detail the interior surface and exterior surface of each glove of the pair. The pair of gloves are additionally fabricated so that each twisted loop thereon the inner surface of each glove of the pair is brushed broken to form a mat surface.

1 Claim, 2 Drawing Sheets

SHOWER AND BATH GLOVE

BACKGROUND OF THE INVENTION

This invention relates to human body cleaning, and more particularly to a pair of gloves adapted for use on each hand of the wearer when showering or bathing.

Mittens and unfitted wash cloths of terry cloth fabric, characterize the art of human body cleaning. Wash cloths often form a ball in the palm of the user's hand, resulting in wasted time and the frustration of opening the wash cloth to continue using them. Mittens eliminate the balling problem of wash cloths, however, mittens restrict the individual usage of the fingers and thumb of the hand. Consequently, hard to reach places such as inside and behind the ear of the user remain unaccessible. Furthermore, the interior surfaces of mittens provided for in the art, are smooth, thereby contributing to slippage on the hand of user, when they are soaped and in use. Also, a smooth inner surface reduces the amount of soap suds the mitten can retain. The foregoing cleaning devices, additionally, have not been adapted for use on both hands of the user. Generally, one hand of the user remains ineffective.

Gloves made of terry cloth fabric are common place to the art of work gloves. Such work gloves, however, have been fabricated from a terry cloth fabric suitable to the specific needs of the workplace; knitted terry cloth, having one side smooth surfaced and one side pile surfaced.

Terry cloth fabric can vary in composition; either being knitted or woven; having twisted loops pile on one or both surface; or having untwisted loops pile on one or both surfaces. The choice of what kind of terry cloth fabric to employ in making a glove, depends on the art to which the glove is directed.

The present invention is directed toward a pair of showering and bathing gloves in which each glove of the pair is provided with an inner surface composed of twisted loops pile, so that the glove can hold a reservoir of soap suds on the inner surface when it is wet and soaped; allowing the user to clean their entire body with one soaping of the gloves.

The present invention provides further, a pair of showering and bathing gloves, being fabricated from a two sided twisted loops surface woven terry cloth fabric, so that when formed, a plurality of twisted loops detail the interior surface and exterior surface of each glove of the pair.

A further specific objective of the invention, is the provision of a pair of showering and bathing gloves, with twisted loops pile covering the exterior surface of each glove of the pair and twisted loops broken to form a mat surface on the interior of the of the gloves. The twist provided for on each loop, being adopted to enhance the cleaning ability of the pair of gloves.

DETAILED DESCRIPTION OF THE DRAWINGS

Figure 1:
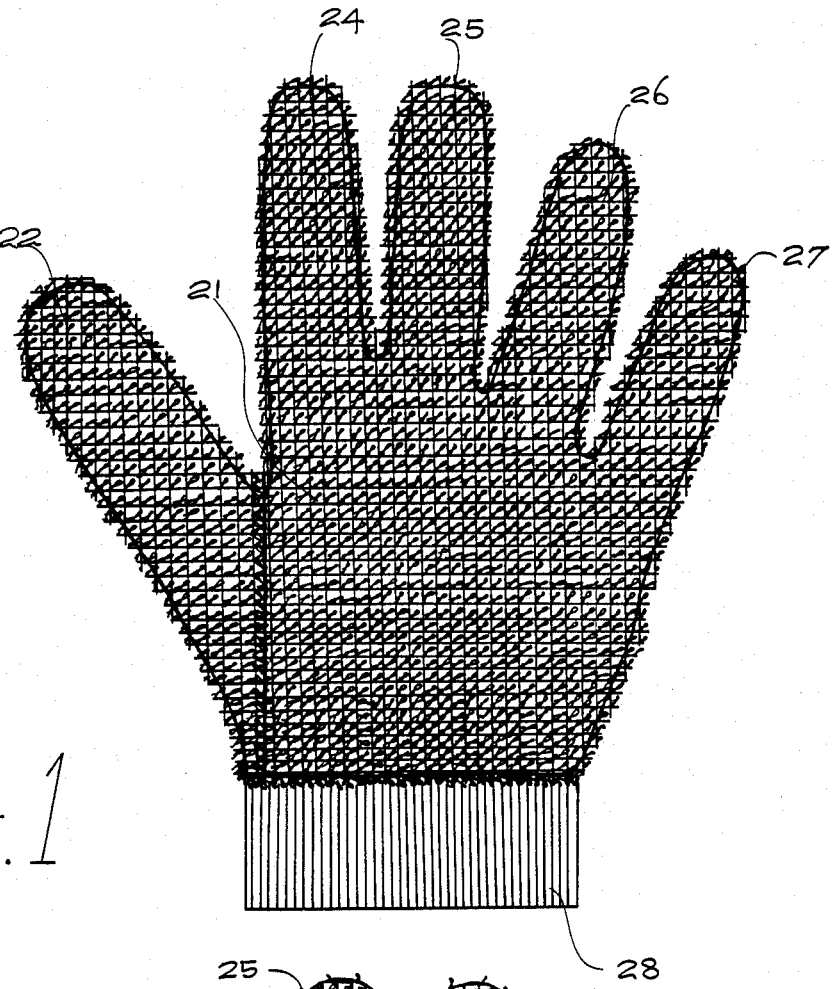
FIG. 1 is a view of the glove turned inside out, to show the twisted loops pile interior surface.
Figure 2:
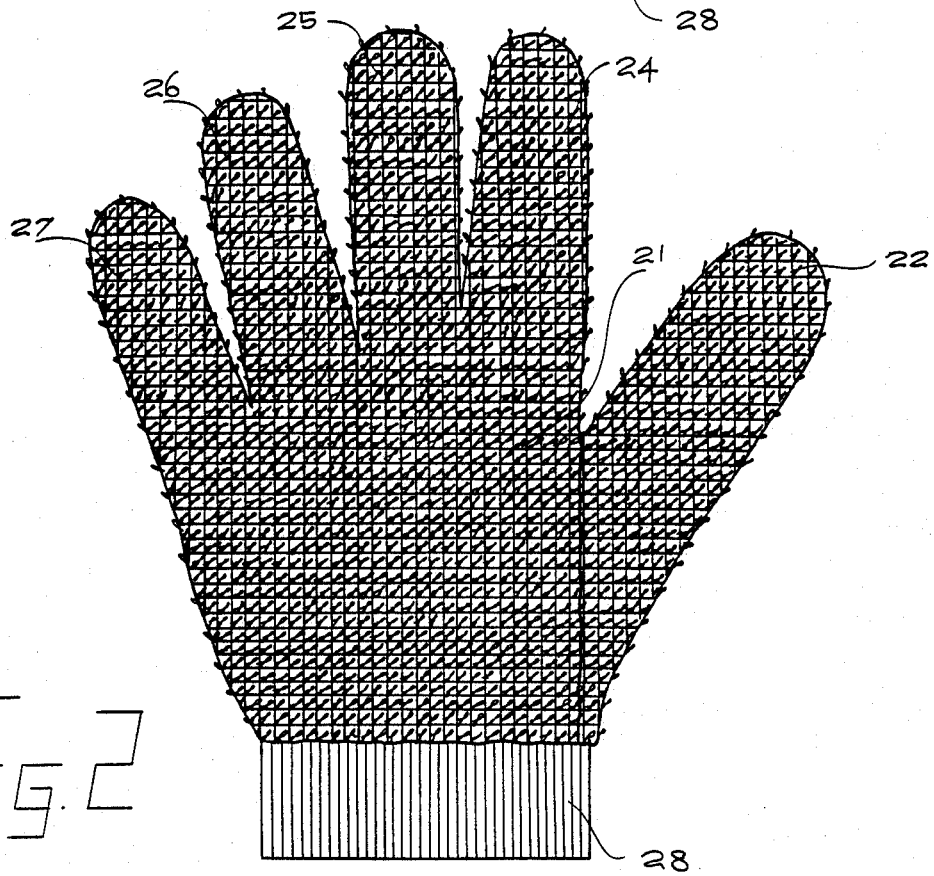
FIG. 2 is a view of the glove showing the exterior surface.
Figure 3:
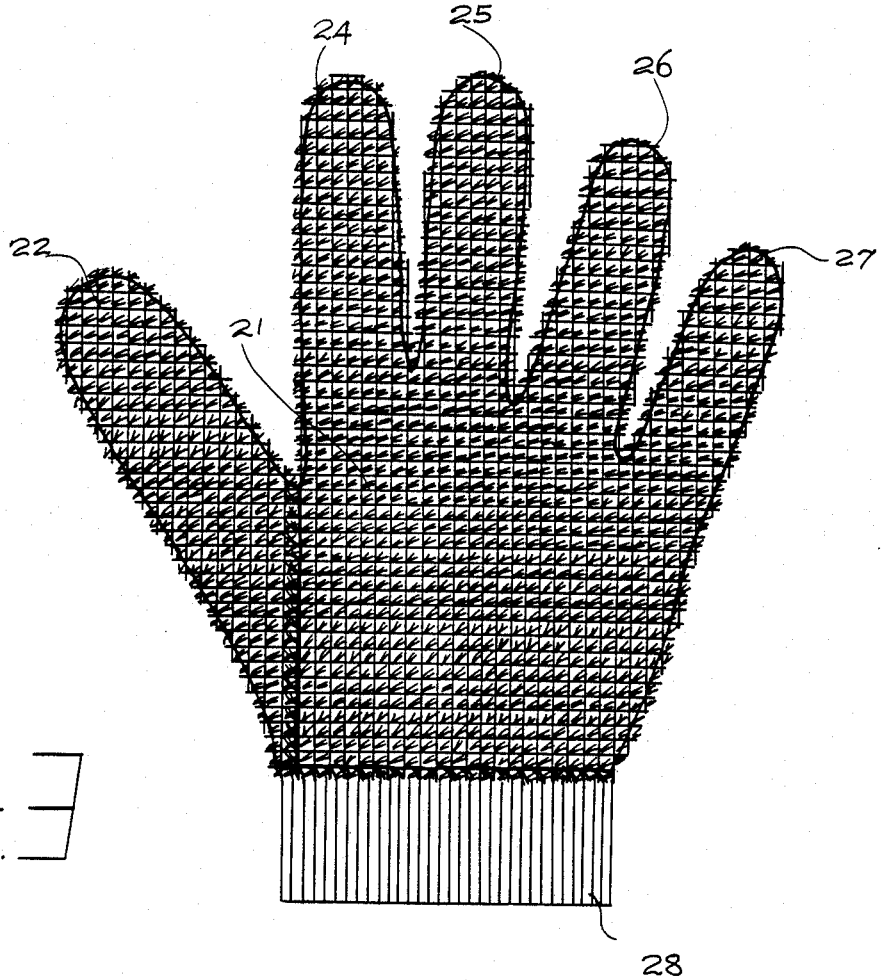
FIG. 3 is a view of the glove interior surface, showing the twisted loops broken to form a mat surface; and, FIG. 4 is an enlarged twisted loop isolated from FIG. 1.
Figure 4:
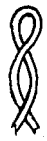

The glove comprises a palm 21, thumb 22, finger chambers 24–27, and an elastic wrist portion 28. The mat inner surface shown in FIG. 3, is obtained by brushing the glove terry cloth twisted loops inner surface, until each loop becomes broken.

The drawings show one glove of the pair, the partner glove is identical to that shown in the drawings.

The gloves are used by fitting on the right and left hands; wetting both fitted hands; placing a portion of soap in the palm thereof, and rubbing, until a reservoir of soap suds develope.

I claim:

1. A body wash glove for use in showering or bathing comprising, a palm area, thumb chamber and finger chambers, and an elastic wrist portion, said glove being formed of woven terry cloth material having inner and outer pile surfaces, said inner surface being defined by twisted loops of pile material that have been brushed broken to form a matt surface, and said outer surface being defined by twisted looks of pile material.

* * * * *